US012078392B2

(12) United States Patent
Yong et al.

(10) Patent No.: US 12,078,392 B2
(45) Date of Patent: Sep. 3, 2024

(54) CONDENSER FOR WATER PURIFIER, METHOD FOR MANUFACTURING CONDENSER FOR WATER PURIFIER, AND WATER PURIFIER HAVING CONDENSER

(71) Applicant: COWAY CO., LTD., Chungcheongnam-do (KR)

(72) Inventors: Min-Chul Yong, Seoul (KR); Chung-Lae Kim, Seoul (KR); Chul-Ho Kim, Seoul (KR); Young-Hoon Hong, Seoul (KR); Hyun-Soo Shin, Seoul (KR); Si-Jun Park, Seoul (KR); Chan-Jung Park, Seoul (KR); Gyeong-Jong Kim, Seoul (KR); Gyeong-Min Lee, Seoul (KR); Byung-Hyo Ye, Seoul (KR); Woong Jung, Seoul (KR)

(73) Assignee: COWAY CO., LTD., Chungcheongnam-Do (KR)

( * ) Notice: Subject to any disclaimer, the term of this patent is extended or adjusted under 35 U.S.C. 154(b) by 231 days.

(21) Appl. No.: 17/779,879

(22) PCT Filed: Nov. 18, 2020

(86) PCT No.: PCT/KR2020/016259
§ 371 (c)(1),
(2) Date: May 25, 2022

(87) PCT Pub. No.: WO2021/112455
PCT Pub. Date: Jun. 10, 2021

(65) Prior Publication Data

US 2022/0412613 A1 Dec. 29, 2022

(30) Foreign Application Priority Data

Dec. 5, 2019 (KR) ..... 10-2019-0161062

(51) Int. Cl.
*F25B 39/04* (2006.01)
*F28D 1/047* (2006.01)

(52) U.S. Cl.
CPC ..... *F25B 39/04* (2013.01); *F28D 1/047* (2013.01)

(58) Field of Classification Search
CPC ..... F25B 39/04
See application file for complete search history.

(56) References Cited

U.S. PATENT DOCUMENTS 5,485,732 A 1/1996 Locatelli
5,806,585 A 9/1998 Yoshida et al.
(Continued)

FOREIGN PATENT DOCUMENTS

CA 2130156 C 10/2005
CN 2123042 U 11/1992
(Continued)

OTHER PUBLICATIONS

International Search Report and Written Opinion issued in corresponding International Application No. PCT/KR2020/016259, mailed Feb. 3, 2021, 8 pages.
(Continued)

*Primary Examiner* — Jason L Vaughan
*Assistant Examiner* — Amanda Kreiling
(74) *Attorney, Agent, or Firm* — Guntin & Gust, PLC; Miyoung Shin

(57) ABSTRACT

Disclosed is a condenser for a water purifier, comprising a pipe provided with a plurality of bending parts which are disposed so as to be vertically overlapping with one another, cooling wires provided on the upper and lower surfaces of the plurality of bending parts; and fixing members for fixing the cooling wires. The cooling wires that are provided on the
(Continued)

surfaces, facing each other, of the plurality of bending parts are disposed so as to alternate with each other.

16 Claims, 8 Drawing Sheets

(56) References Cited

U.S. PATENT DOCUMENTS

| | | | |
|---|---|---|---|
| 2002/0185267 | A1 | 12/2002 | Ohgaki |
| 2008/0256972 | A1 | 10/2008 | Knoll et al. |
| 2010/0236762 | A1 | 9/2010 | Lafaire |
| 2018/0058772 | A1 | 3/2018 | Baker et al. |

FOREIGN PATENT DOCUMENTS

| | | | | |
|---|---|---|---|---|
| CN | 1160163 | C | | 8/2004 |
| CN | 102607214 | A | | 7/2012 |
| CN | 207540198 | U | | 6/2018 |
| CN | 109661553 | A | | 4/2019 |
| CN | 107702388 | A | | 2/2020 |
| DE | 102006022629 | A1 | | 11/2007 |
| GB | 786255 | A | | 11/1957 |
| JP | S41014821 | B | | 8/1966 |
| JP | S44-013738 | Y1 | | 6/1969 |
| JP | S49-101345 | U | | 8/1974 |
| JP | S50-105070 | U | | 8/1975 |
| JP | S52-006267 | U | | 1/1977 |
| JP | S54-181371 | U | | 12/1979 |
| JP | S62-143166 | U | | 9/1987 |
| JP | 03169482 | A | | 7/1991 |
| JP | H05-340685 | A | | 12/1993 |
| JP | H06265288 | A | | 9/1994 |
| JP | H08320192 | | | 12/1996 |
| JP | 2001317854 | A | | 11/2001 |
| KR | 1019980021263 | A | | 6/1998 |
| KR | 1019990065789 | A | | 8/1999 |
| KR | 1020010027744 | A | | 4/2001 |
| KR | 20170063453 | A | * | 6/2017 |
| KR | 1020170063453 | A | | 6/2017 |
| WO | 0053988 | A1 | | 9/2000 |
| WO | 2006009339 | A1 | | 1/2006 |

OTHER PUBLICATIONS

Chinese Office Action for Counterpart Chinese Application No. 202080084262.4, mailed May 9, 2023, 8 Pages.

Supplementary European Search Report for Counterpart European Application No. 20896199.5—1002 / 4060253, mailed Apr. 21, 2023, 140 pages.

Japanese Office Action for Corresponding JP Application No. JP 2022-530814, mailed May 7, 2024 (7 Pages).

* cited by examiner

CONDENSER FOR WATER PURIFIER, METHOD FOR MANUFACTURING CONDENSER FOR WATER PURIFIER, AND WATER PURIFIER HAVING CONDENSER

TECHNICAL FIELD

The present disclosure relates to a condenser for a water purifier, a method for manufacturing a condenser for a water purifier, and a purifier including a condenser.

BACKGROUND ART

A water purifier is an apparatus for filtering raw water to produce purified water, and may include a cold water production unit producing cold water. Such a cold water production unit may use a tank cooling method in which water, contained in a cold water tank, is cooled by a refrigerant pipe (an evaporator). Alternatively, such a cold water production unit may use an ice storage cooling method in which a refrigerant pipe (an evaporator), through which a refrigerant flows, and a cold water production pipe, through which purified water flows, are installed inside an ice storage tank, and an ice storage liquid contained in the ice storage tank is then cooled by the refrigerant pipe (the evaporator) and the cooled ice storage liquid or ice exchanges heat with purified water, flowing through the cold water production unit, to discharge the cold water.

To this end, the refrigerant pipe (the evaporator) is connected to a compressor, a condenser, and an expansion valve to constitute a cooling cycle.

The condenser generates heat during condensation of the refrigerant. A fin-and-tube method, in which a plurality of aluminum fins are attached to an external surface of a condenser tube, has been widely used in a water purifier to efficiently dissipate heat of a condenser. In addition, air is supplied to the condenser through the blowing fan to cool the condenser.

However, in a fin-and-tube type condenser, dust is easily accumulated in a connection portion of a fin and a tube to deteriorate heat dissipation efficiency. To address the above issue, a water purifier according to the related art includes a filtering member (a mesh net), installed to filter dust in a housing (a main body case) portion corresponding to a fin-and-tube type condenser, and a blowing fan installed between the mesh net and the condenser to suck and supply air, passing through the filtering member, to the fin-and-tube type condenser. In this case, heat dissipation and cooling of the fin-and-tube type condenser is performed as air outside of the housing is introduced into the housing, but air exchanging heat with the condenser is not efficiently discharged outwardly of the housing and sojourns inside the housing to increase temperature inside the housing.

In the case of a large-sized cooling system, a pipe is bent and a cooling wire is attached to the bent pipe, and the bent pipes, provided with cooling wires attached thereto, are stacked to improve efficiency of a condenser. However, such a structure is incapable of being used for domestic/commercial water purifiers. For example, in the case in which bent tubes are stacked, cooling wires installed in a pipe overlap each other to increase a volume of a condenser.

SUMMARY OF INVENTION

Technical Problem

An aspect of the present disclosure is to provide a condenser for a water purifier, capable of suppressing an increase in volume of a condenser.

An aspect of the present disclosure is to provide a water purifier including a purifier, capable of preventing foreign objects such as dust from being stuck to a heat dissipation fin.

An aspect of the present disclosure is to provide a water purifier including a condenser, capable of efficiently suppressing an increase in temperature inside a main body case of the water purifier and reducing a load on a cooling system to achieve noise reduction.

An aspect of the present disclosure is to provide a method for manufacturing a condenser, capable of suppressing an increase in volume thereof.

Solution to Problem

According to an aspect of the present disclosure, a condenser for a water purifier includes: a pipe including a plurality of bending portions disposed to vertically overlap each other; a cooling wire installed on each of upper surfaces and lower surfaces of the plurality of bending portions; and a fixing member configured to fix the cooling wire. The cooling wires installed on surfaces, disposed to oppose each other, of the plurality of bending portions are alternately disposed.

The cooling wires installed on one surface of the bending portion may be disposed to have a plurality of rows.

The cooling wire may have a diameter of 1.0 mm to 1.2 mm.

The pipe may have a diameter of 4.5 mm to 5 mm.

The pipe may further include a connection portion connecting a plurality of bending portions.

The pipe may include a first bending portion provided with an inlet, a first connection portion extending from an end of the first bending portion; a second bending portion connected to an end of the first connection portion; a second connection portion extending from an end of the second bending portion; a third bending portion connected to an end of the second connection portion; a third connection portion extending from an end of the third bending portion; a fourth bending portion connected to an end of the third connecting portion; a fourth connection portion extending from an end of the fourth bending portion; and a fifth bending portion connected to the end of the fourth connecting portion and provided with an outlet.

One end of the cooling wire installed in the first bending portion, both ends of the cooling wires installed in the second to fifth bending portions, and the other end of the cooling wire installed in the fifth bending portion may be bent.

According to an aspect of the present disclosure, a water purifier includes: a main body case having an internal space and provided with a suction port through which external air is introduced; a condenser of one of claims 1 to 7, installed in the internal space of the main body case and disposed in a discharge port of the main body case; a blowing fan disposed on a front end of the condenser to allow air in the internal space of the main body case to pass through the condenser and to then be discharged outwardly of the main body case; and a cold water production unit disposed in the internal space of the main body case to produce cold water using a cooling system including the condenser. The air in the internal space of the main body case is discharged outwardly of the main body case after passing through the condenser.

According to an aspect of the present disclosure, a method for manufacturing a condenser for a water purifier includes: bending a pipe to form a plurality of bending portions;

comparing an even or odd bending portion, among the plurality of bending portions, with an adjacent bending portion to move the even or odd bending portion upwardly or downwardly by a predetermined interval; installing a wire on an upper surface and a lower surface of the bending portion to form a plurality of rows; removing a wire, disposed between the bending portions adjacent to the plurality of bending portions, to form a cooling wire; and bending the pipe to overlap the plurality of bending portions with each other. In the bending the pipe to overlap the plurality of bending portions with each other, an even or odd bending portion may be moved downwardly or upwardly, opposing an initial moving direction, to overlap an adjacent bending portion.

The predetermined interval may correspond to half of an interval between the rows of the wire.

Cooling wires disposed on opposing surfaces of the bending portion may be alternately disposed when the pipe is bent to overlap the plurality of bending portions with each other.

The cooling wire may have a diameter of 1.0 mm to 1.2 mm.

The pipe may have a diameter of 4.5 mm to 5 mm.

After bending the pipe to overlap the plurality of bending portions with each other, the method may further include compressing the pipe while correcting a shape of the pipe and installing a fixing member on the cooling wire.

The installing the fixing member on the cooling wire may include installing screws in an upper portion and a lower portion of the fixing member disposed to surround the cooling wire.

After installing the fixing member on the cooling wire, the method may further include bonding a copper tube, through which a refrigerant flows, to the pipe.

Advantageous Effects of Invention

According to an aspect of the present disclosure, efficiency of a condenser may be improved and an increase in volume of the condenser may be suppressed.

In addition, foreign objects such as dust may be prevented from being stuck to a heat dissipation fin provided in a condenser.

In addition, an increase in temperature inside a main body case may be efficiently suppressed, and a load on a cooling system may be reduced to achieve noise reduction.

BEST MODE FOR INVENTION

Figure 1:
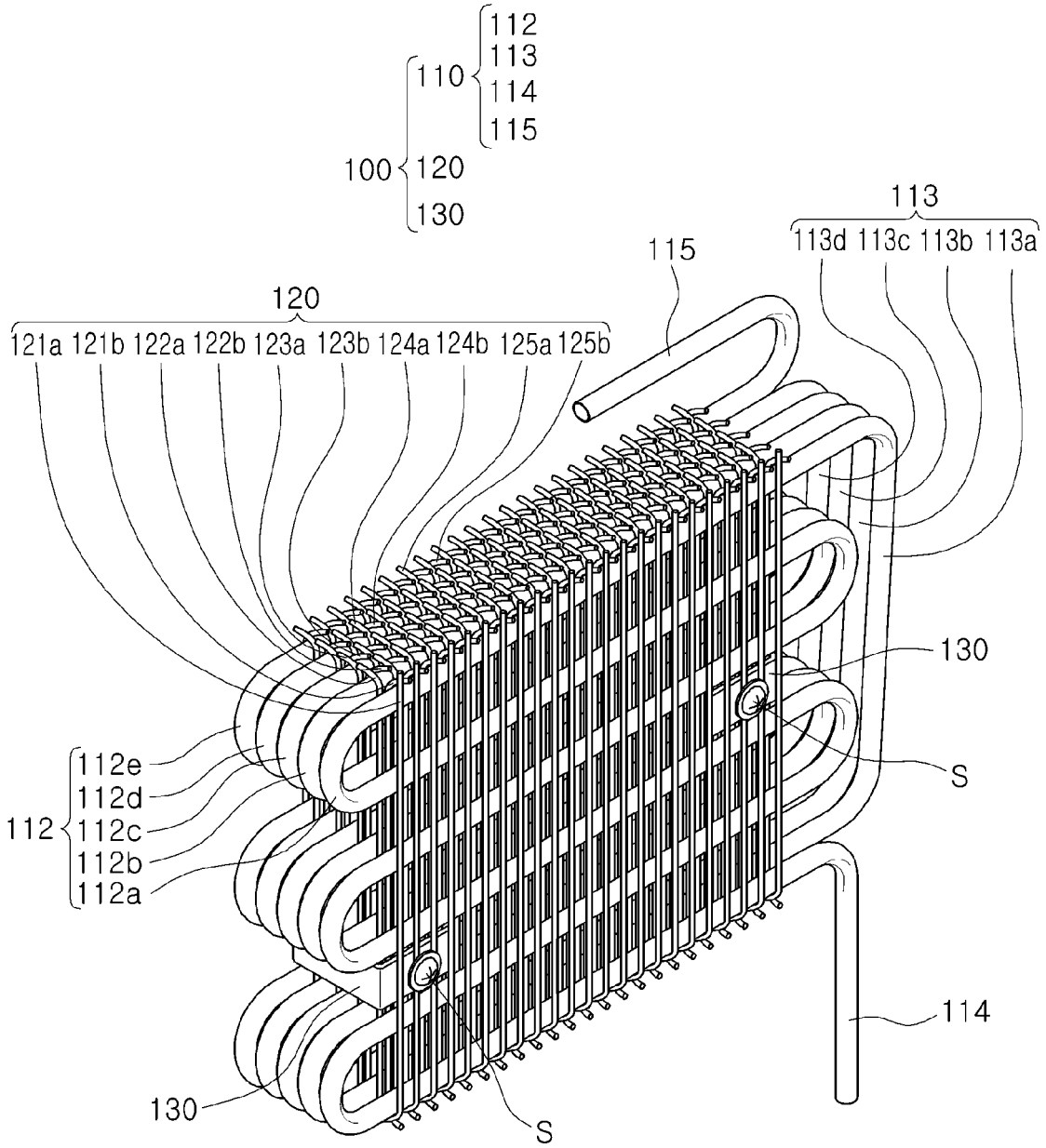
FIG. 1 is a schematic plan view illustrating a condenser for a water purifier according to an embodiment of the present disclosure.

Hereinafter, exemplary embodiments in the present disclosure will be described hereinafter with reference to the accompanying drawings. The present disclosure may, however, be exemplified in many different forms and should not be construed as being limited to the specific embodiments set forth herein. Rather, these embodiments are provided so that this disclosure will be thorough and complete, and will fully convey the scope of the invention to those skilled in the art. In the drawings, the same reference numerals will be used throughout to designate the same or like elements, and the shapes and dimensions of elements may be exaggerated for clarity.

Figure 2:
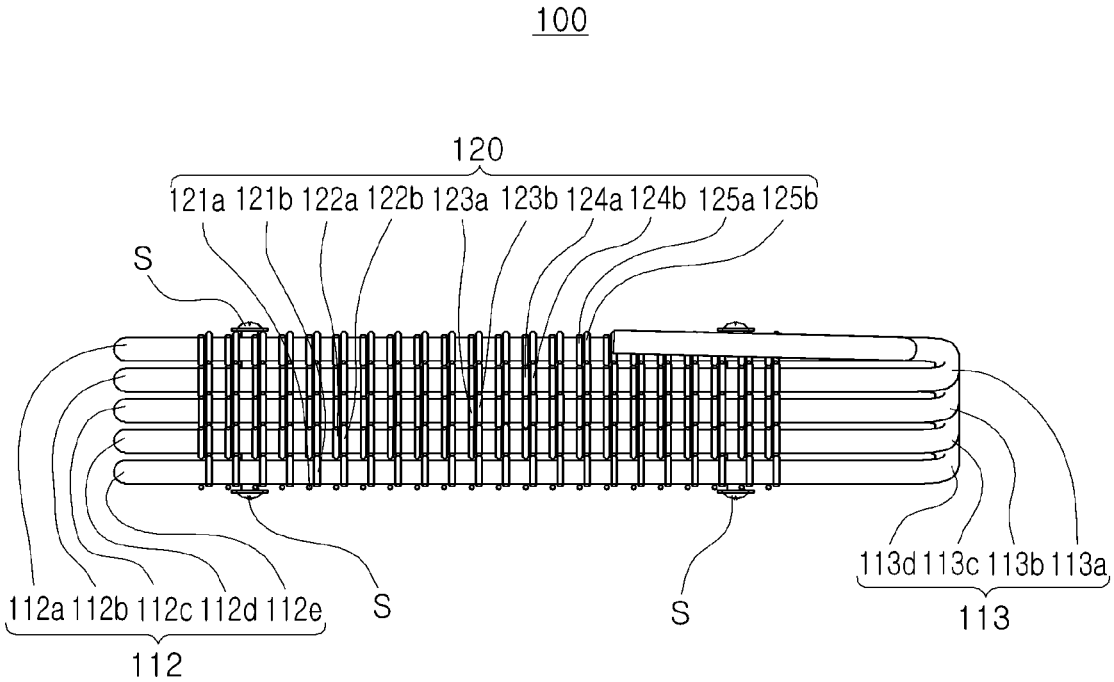
FIG. 2 is a schematic side view illustrating a condenser of a water purifier according to an embodiment of the present disclosure.

FIG. 1 is a schematic plan view illustrating a condenser for a water purifier according to an embodiment of the present disclosure, and FIG. 2 is a schematic side view illustrating a condenser of a water purifier according to an embodiment of the present disclosure.

Referring to FIGS. 1 and 2, a condenser 100 for a water purifier according to an embodiment may include, for example, a pipe 110, a cooling wire 120, and a fixing member 130.

The pipe 110 provides a space in which the refrigerant of a cooling system (not illustrated), connected to the condenser 100, flows. The pipe 110 may include a bending portion 112 in which a U-shaped curved surface and a straight line are continuously arranged when viewed from above. As an example, the bending portion 112 may be provided with five U-shaped tubes and six straight tubes when viewed from above. As an example, the bending portion 112 may be disposed such that five bending portions are disposed.

For example, the bending portion 112 may include a first bending portion 112*a* disposed on an uppermost layer thereof, a second bending portion 112*b* disposed below the first bending portion 112*a*, a third bending portion 112*c* disposed below the second bending portion 112*c*, a fourth bending portion 112*d* disposed below the third bending portion 112*c*, and a fifth bending portion 112*e* disposed below the fourth bending portion 112*d*.

In the present embodiment, the bending portion 112 has been described as including five bending portions, but the number of the bending portions is not limited thereto and may vary according to exemplary embodiments.

The pipe 110 may include a connection portion 113 connecting the bending portions of the bending portion 112. For example, the connection portion 113 may include a first connection portion 113*a* connecting the first bending portion 112*a* and the second bending portion 112*b* to each other, a second connection portion 113*b* connecting the second bending portion 112*b* and the third bending portion 112*c* to each other, a third connection portion 113*c* connecting the third bending portion 112*c* and the fourth bending portion 112*d* to each other, and a fourth connecting portion 113*d* connecting the fourth bending portion 112*d* and the fifth bending portion 112*e* to each other.

The bending portion 112 including a plurality of layers, for example, the first to bending portions 112*a* to 112*e* may be disposed to overlap each other. For example, the first to fifth bending portions 112*a* to 112*e* may be disposed such that at least outermost portions thereof overlap each other when viewed from above.

The pipe 110 may include an inlet 114, extending from the first bending portion 112*a*, and an outlet 115 extending from the fifth bending portion 112*e* disposed on a lowermost layer thereof.

The pipe 110 may have a diameter of about 4.5 mm to about 5.5 mm. As an example, the pipe 110 may have a diameter of 4.8 mm.

The cooling wire 120 may be disposed above and below the pipe 110. For example, the cooling wire 120 may be disposed above and below each of the first to fifth bending portions 112*a* to 112*e*. For example, the cooling wire 120 may include a 1-1-th cooling wire 121*a*, bonded to an upper surface of the first bending portion 112*a*, and a 1-2-th cooling wire 121*b* bonded to a lower surface of the first bending portion 112*a*. Also, the cooling wire 120 may include a 2-1-th cooling wire 122*a*, bonded to an upper surface of the second bending portion 112*b*, and a 2-2-th cooling wire 122*b* bonded to a lower surface of the second bending portion 112*b*. Also, the cooling wire 120 may include a 3-1-th cooling wire 123*a*, bonded to an upper surface of the third bending portion 112*c*, and a 3-2-th cooling wire bonding 122*c* bonded to a lower surface of the third bending portion 112*c*). Also, the cooling wire 120 may include a 4-1-th cooling wire 124*a*, bonded to an upper surface of the fourth bending portion 112*d*, and a 4-2-th cooling wire 124*b* bonded to a lower surface of the fourth bending portion 112*d*. Moreover, the cooling wire 120 may include a 5-1-th cooling wire 125*a*, bonded to an upper surface of the fifth bending portion 112*e*, and a 5-2-th cooling wire 125*b* bonded to a lower surface of the fifth bending portion 112*e*.

As an example, the 1-2-th cooling wire 121*b* and the 2-1-th cooling wire 122*a* are alternately disposed. For example, the 1-2-th cooling wire 121*b* and the 2-1-th cooling wire 122*a* may be alternately disposed. Further, the 2-2-th cooling wire 122*b* and the 3-1-th cooling wire 123*a* may also be alternately disposed. In addition, the 3-2-th cooling wire 123*b* and the 4-1-th cooling wire 124*a* may also be alternately disposed, and the 4-2-th cooling wire 124*b* and the 5-1-th cooling wire 125*a* may also be alternately disposed.

As described above, since the cooling wires 120 facing each other are alternately disposed, the volume increase by the cooling wire 120 may be decreased. This will now be described in brief. As an example, during manufacturing, the cooling wire 120 may be installed after the second bending portion 112*b* and the fourth bending portion 112*d* are upwardly moved. When the first to fifth bending portions 112*a* to 112*e* are bent overlap each other by bending the pipe 110, the second bending portion 112*b* and the fourth bending portion 112*d* may be downwardly moved and then bent, so that beam cooling wires 120 facing each other may be alternately disposed.

The term "an alternately arranged state" refers to, for example, a state in which the cooling wires 120 facing each other are sequentially arranged in a line without intersecting or overlapping each other. For example, an overlying cooling wire 120*s* and an underlying cooling wire 120*s*, adjacent to each other, may constitute a single layer without being interposed to overlap each other.

For example, the term "an alternately arranged state" means that the 1-2-th cooling wire 121*b* and the 2-1-th cooling wire 122*a* do not intersect or overlap each other, and the 1-2-th cooling wire 121*b*, the 2-1-th cooling wire 122*a*, the 1-2-th cooling wire 121*b*, and the 2-1-th cooling wire 122*a* are sequentially disposed.

Except for one end portion of each of the 1-1-th cooling wire 121*a* and the 1-2-th cooling wire 121*b* and the other end portion of each of the 5-1-th cooling wire 125*a* and the 5-2-th cooling wire 125*b*, remaining cooling wires may be bent. For example, except for one end portion of the 1-1-th cooling wire 121*a* and one end portion of the 1-2-th cooling wire 121*b* as well as the other end portion of the 5-1-th cooling wire 125*a* and the other end portion of the 5-2 cooling wire 125*b*, remaining cooling wires may be bent in one direction when press cutting is performed to form the cooling wire 120 during manufacturing. Then, the first to fifth bending portions 112*a* to 112*e* may be bent to overlap each other, so that an end of the cooling wire 120 may be bent to a side of a central portion of the bending portion 112, except for one end portion of the 1-1-th cooling wire 121*a* and one end portion of the 1-2-th cooling wire 121*b* as well as the other end portion of the 5-1-th cooling wire 125*a* and the other end portion of the 5-2 cooling wire 125*b*.

As an example, the cooling wire 120 may have a diameter of 1.0 mm to 1.2 mm.

In the present embodiment, an example in the cooling wires 120 are respectively installed on upper and lower surfaces of the bending portion 112 has been described, but the cooing wire 120 may be installed on only the upper or lower surface of the bending portion 112.

The fixing member 130 may serve to fix the cooling wire 120. As an example, the fixing member 130 may be disposed to surround a portion of the cooling wire 120. For example, the fixing member 130 may have a "c" shape. The fixing member 130 may be fixed by a screw S. As an example, a single screw S for fixing the fixing member 130 may be installed in each of upper and lower portions of the fixing member 130. In addition, the fixing member 130 may be provided with a plurality of fixing members 130 to fix the cooling wire 120.

In the present embodiment, the case in which two fixing members 130 are provided has been described as an example, but the number of installed fixing members 130 may vary according to exemplary embodiments. In addition, although not illustrated, a bracket member for fixing the condenser 100 to a frame (not illustrated) provided in the main body case 210 (see FIG. 3) may be connected to the fixing member 130.

As described above, efficiency may be improved while suppressing an increase in volume through the bending portion 112 constituting a plurality of layers disposed to overlap each other.

In addition, the efficiency may be further improved while suppressing an increase in volume through the cooling wire 120 including a plurality of layers, alternately disposed.

In addition, since a contact portion to which the pipe 110 and the cooling wire 120 are fixed has a curved structure and has a small contact area, accumulation of foreign objects such as dust in the condenser 100 may be reduced. In particular, since foreign objects such as dust accumulated on the surface of the condenser 100 are removed in a process of blowing air to the condenser 100, an additional cleaning operation is not required.

In addition, since heat dissipation of the condenser 100 may be prevented from being decreased by the accumulation of dust in the condenser 100, a load of the cooling system (not illustrated) such as a compressor, or the like, may be reduced. Thus, noise generated during driving of the cooling system may be reduced.

Hereinafter, a water purifier including the above-described condenser will be described.

Figure 3:
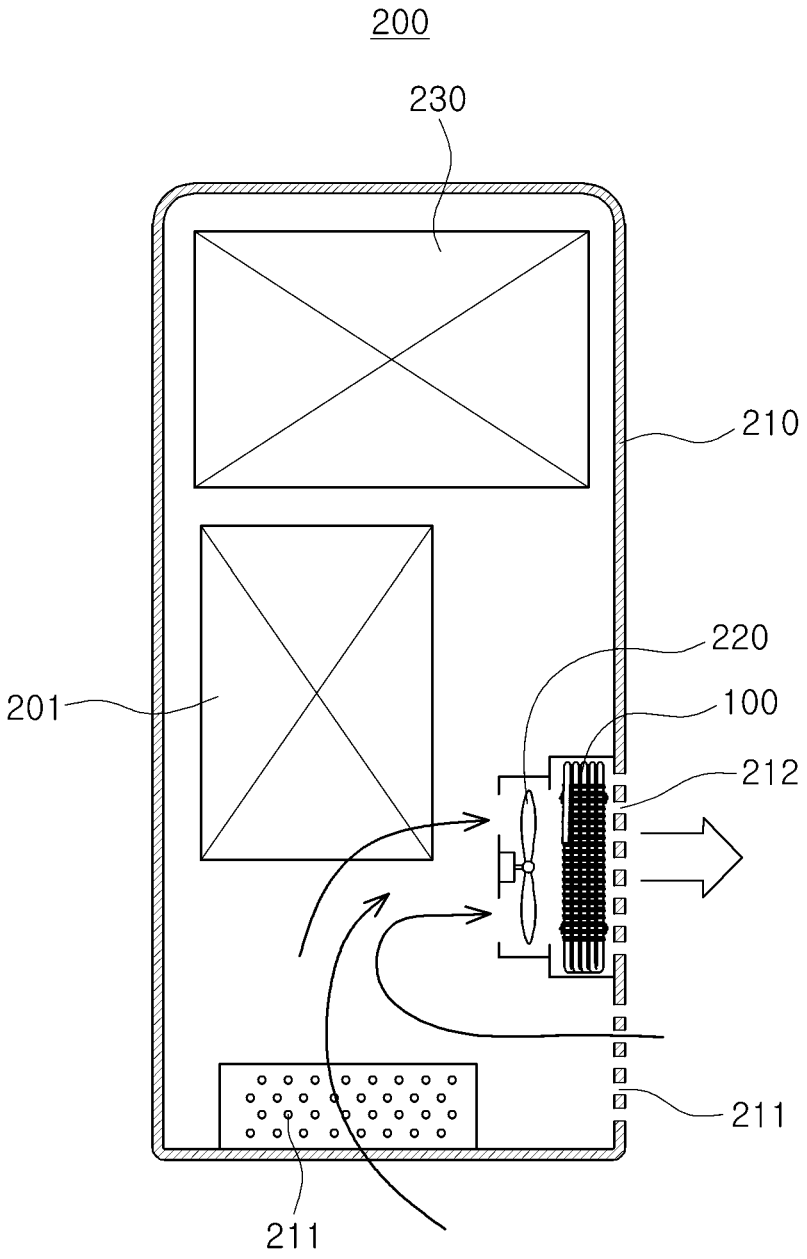
FIG. 3 is a schematic view illustrating a configuration of a water purifier according to an embodiment of the present disclosure.

FIG. 3 is a schematic view illustrating a configuration of a water purifier according to an embodiment of the present disclosure.

Referring to FIG. 3, a water purifier 200 according to an embodiment may include, for example, a main body case 210, a condenser 100, a blowing fan 220, and a cold water production unit 230.

As an example, the main body case 210 may have an internal space. At least one of a rear surface and a side surface of the main body case 210 may be provided with a suction port 211 through which external air is introduced. In addition, the main body case 210 may be provided with a discharge port 212 through which air is discharged outwardly of the main body case 210 from an inside thereof. As an example, the discharge port 212 may be disposed above the suction port 211 to discharge air having a relatively high temperature.

The main body case 210 may be provided with a filter unit 201 including a plurality of filters to purify introduced raw water.

The condenser 100 may connected to a compressor, an expansion valve, and an evaporator (not illustrated) to constitute a cooling system. In addition, the condenser 100 may be installed in an internal space of the main body case 210 to be disposed on a front end of the discharge port 212. The condenser 100 may be substantially the same component as the above-described condenser 100, and a detailed description thereof will be omitted. In addition, the condenser 100 may discharge heat to the outside thereof when a refrigerant flowing in the pipe 110 (see FIGS. 1 and 2) is condensed.

As described above, since the water purifier 100 according to an embodiment has a structure in which dust does not accumulate in the condenser 100 and the dust is easily discharged during blowing, a filter member (a mesh net) for filtering air introduced into the condenser 100 does not need to be additionally installed. Accordingly, the blowing fan 220 may be disposed on a flow path on a front end of the condenser 100.

For example, the blowing fan 220 may be disposed on a front end of the condenser 100 such that air inside the main body case 210 is discharged to the outside of the main body case 210 through the discharge port 212 of the main body case 210 after exchanging heat while passing through the condenser 100. Accordingly, the air heated by exchanging heat with the condenser 100 may be directly discharged to the outside of the main body case 210, so that the heat dissipation performance of the condenser 100 may be improved and an increase in temperature inside the main body case 210 may be suppressed.

This will now be described in greater detail. In the related art, air outside a main body case was filtered through a filter member (a mesh net) by suction power of a blowing fan to the main body case, and then passed through the blowing fan and the condenser 100. The air passing through the blowing fan and the condenser 100 exchanged heat with the condenser 100 to increase temperature of the air, and the temperature-increased air was not smoothly discharged through a discharge port to be held in an internal space of the main body case 210. Accordingly, heat was transferred from the condenser 100 and the heat-transferred air held in the main body case 210, resulting in an increase in temperature inside the main body case 210. For example, when the condenser 100 was driven in a state in which the temperature inside the main body case 210 is about 35° C. (temperature of a space in which a water purifier was installed) before the condenser 100 is driven, the temperature inside the main body case 210 was increased to about 60° C. Furthermore, when the condenser 100 was driven in a state in which the internal temperature of the main body case 210 was approximately 40° C. (the temperature of the space in which the water purifier was installed) before the condenser 100 was driven, the temperature inside the main body case 210 was significantly increased to fail to cool a refrigerant using the condenser 100.

Meanwhile, in the present disclosure, even when the condenser 100 is driven in a state in which temperature inside the main body case 210 is about 35° C. (temperature of a space in which a water purifier is installed) before the condenser 100 is driven, a state of about 35° C. (the temperature of a space in which a water purifier is installed) may be maintained. Furthermore, in the case of the present invention, even when the condenser 100 is driven in a state in which the temperature inside the main body case 210 is about 40° C. (temperature of a space in which a water purifier is installed) before the condenser 100 is driven, a state of about 40° C. (the temperature of a space in which a water purifier is installed) may be maintained.

As described above, an increase in the temperature inside the main body case 210 may be suppressed to improve cold water production efficiency of the water purifier 200.

The cold water production unit 230 may be disposed in the internal space of the main body case 210 to produce cold water through a cooling system (not illustrated) including the condenser 100.

The cold water production unit 230 may use a tank cooling method in which water contained in the cold water tank is directly cooled by an evaporator (not illustrated) of the cooling system. Alternatively, after installing an evaporator (not illustrated), through which a refrigerant flows, and a cold water production pipe, through which purified water, in an ice storage tank, an ice storage liquid contained in the ice storage tank may be cooled by the evaporator and the cooled ice storage liquid or ice may then exchange heat with the purified water, flowing through the cold water production pipe. Since the cold water production unit 230 uses various methods for production cold water, a detailed description thereof will be omitted.

As described above, air passing through the condenser 100 may be discharged from the inside of the main body case 210 to the outside thereof to prevent the temperature inside the main body case 210 from increasing.

Accordingly, efficiency of the water purifier 200, such as cooling efficiency, may be improved.

Hereinafter, a method for manufacturing a condenser according to an embodiment will be described with reference to accompanying drawings.

Figure 4:
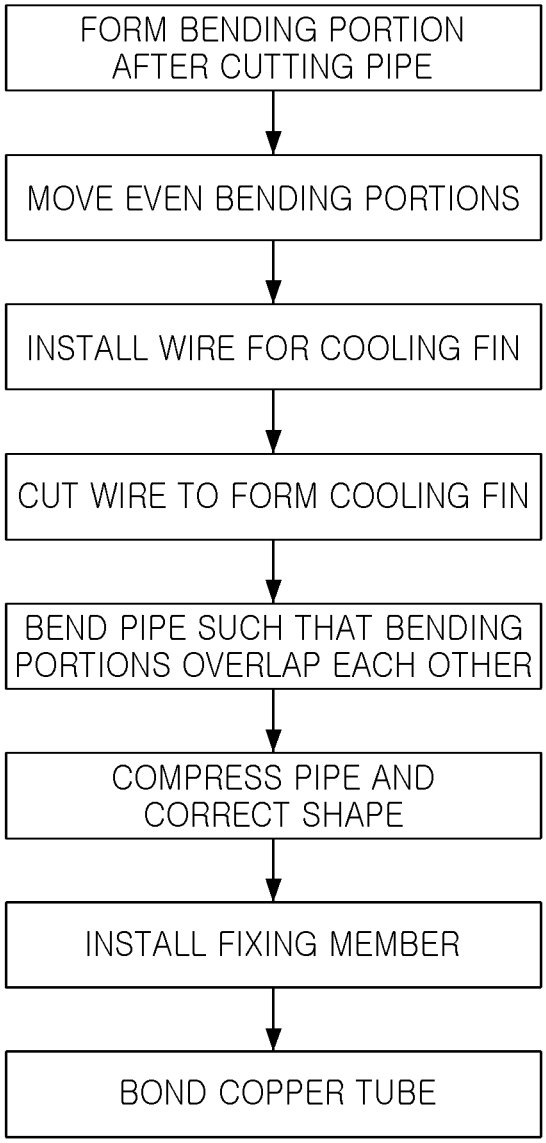
FIG. 4 is a flowchart illustrating a method for manufacturing a condenser for a water purifier according to an embodiment of the present disclosure.

FIG. 4 is a flowchart illustrating a method for manufacturing a condenser for a water purifier according to an embodiment.

Figure 5:
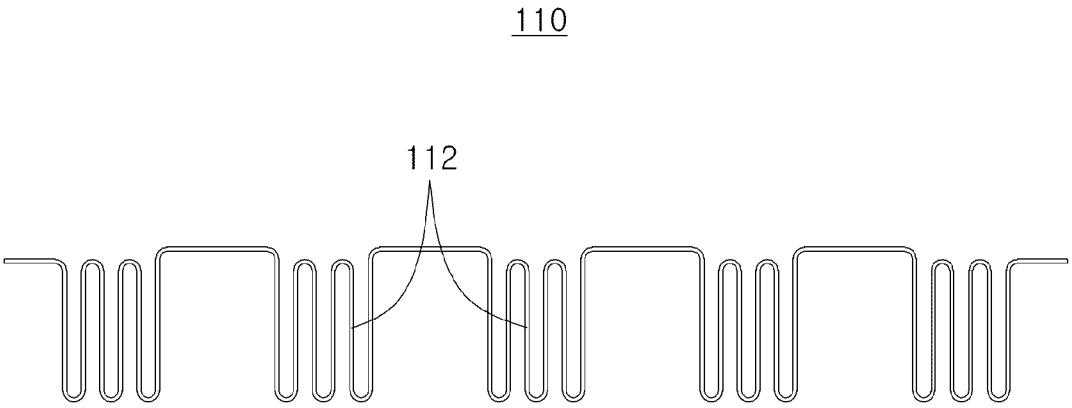
FIGS. 5 to 8 are views illustrating a method for manufacturing a condenser for a water purifier according to an embodiment of the present disclosure.

Referring to FIG. 4, an operator may bend a straight line type pipe after cutting the pipe. Accordingly, the pipe 110 may have, for example, five bending portions 112, as illustrated in FIG. 5. However, in the present embodiment, a case in which the pipe 110 has five bending portions 112 is described as an example, but the number of the bending portions 112 may vary according to exemplary embodiments.

Figure 6:
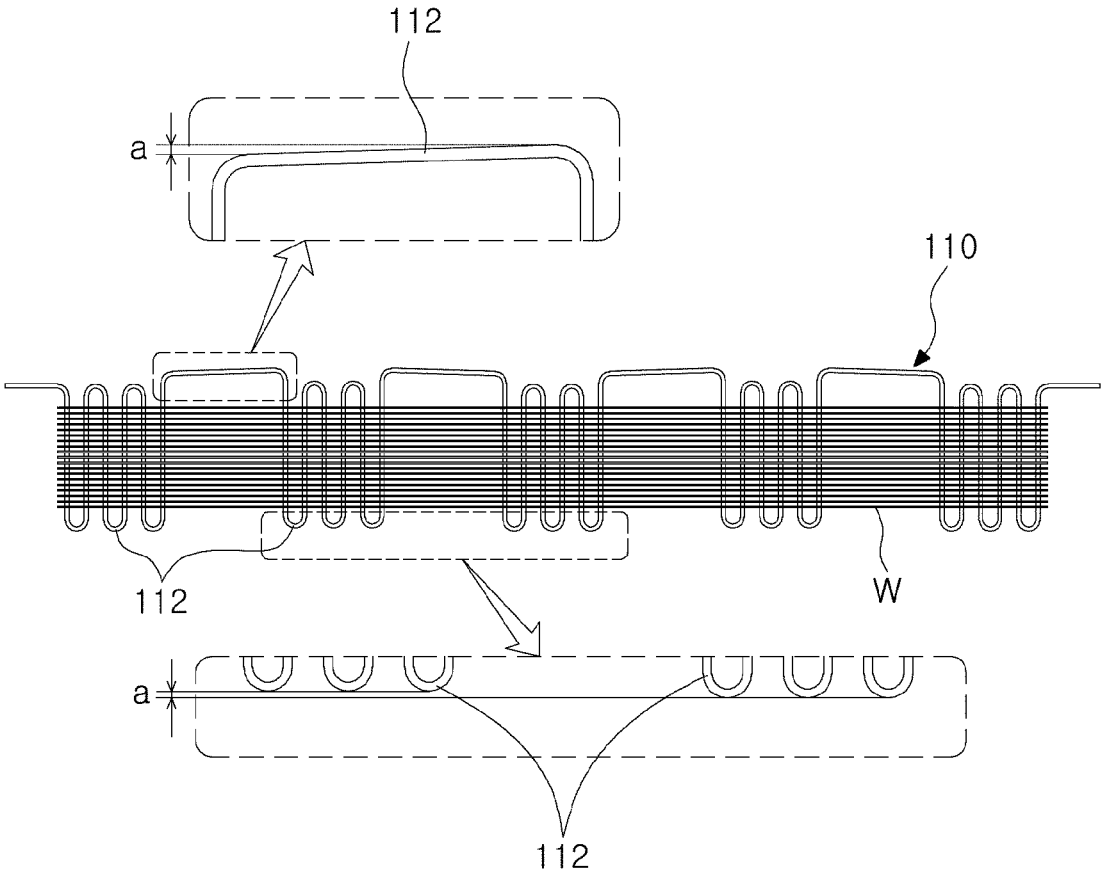

Then, as illustrated in FIG. 6, the operator may move even bending portions 112 upwardly or downwardly by a predetermined interval "a" and may dispose odd bending portions 112 to be parallel to each other. However, the present disclosure is not limited thereto, and the operator may move odd bending portions 112 upwardly or downwardly by the predetermined interval "a" and may dispose even bending portions 112 to be parallel to each other.

In this case, the predetermined interval may be equal to about half (about 40% to 60%) of an arrangement interval (an interval between rows) of the wire W to be described later. For example, when the arrangement interval of the wire W is 5 mm, a predetermined interval at which the bending portion 112 is moved may be 2.5 mm (about 2 mm to about 3 mm).

Then, as illustrated in FIG. 6, the operator may install a wire W to be formed into the cooling wire 120 (see FIGS. 1 and 2) on each of an upper surface and a lower surface of the pipe 110. The wire to be formed into the cooling wire 120 may be bonded to be installed on the pipe 110 by welding.

Figure 7:
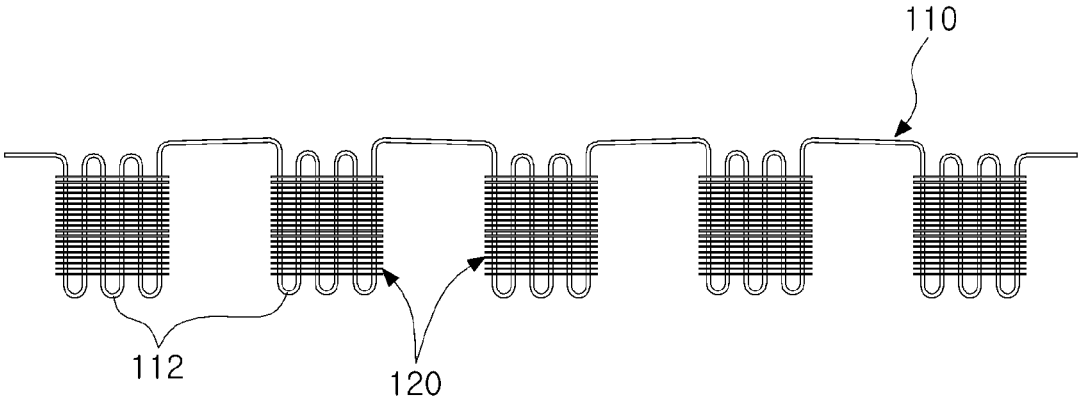

Then, as illustrated in FIG. 7, the operator may cut the wire to remove unnecessary wire portions disposed between the bending portions 112. Accordingly, an end of the cooling wire 120 may be bent in a direction in which a cutting press is moved.

Then, the pipe 110 may be bent through a bending facility (not illustrated) such that the bending portions 112 overlap each other. In this time, the pipe 110 may be bent while returning the even bending portions 10 to original positions thereof. Accordingly, the cooling wire 120 installed on the pipe 110 may be disposed to be displaced from each other.

Then, the operator may compress the pipe 110, in which the cooling wire 120 is installed, through a compressor (not illustrated). In this case, a correction fin may correct a shape of the pipe 110 to accurately overlap the bending portions 112 formed to have a plurality of layers. To correct the shape of the pipe 110, the correction fin may include a plurality of correction fin used to be inserted into the bending portions 112 or to contact the bending portions 112 to an external entity.

After bending an even bending portion in a direction, perpendicular to a vertical direction, in the state of FIG. 7 without returning to an original position thereof, the even bending portion 10 may return to the original position thereof such that the bending portions 112 may have an accurately overlapping shape.

Figure 8:
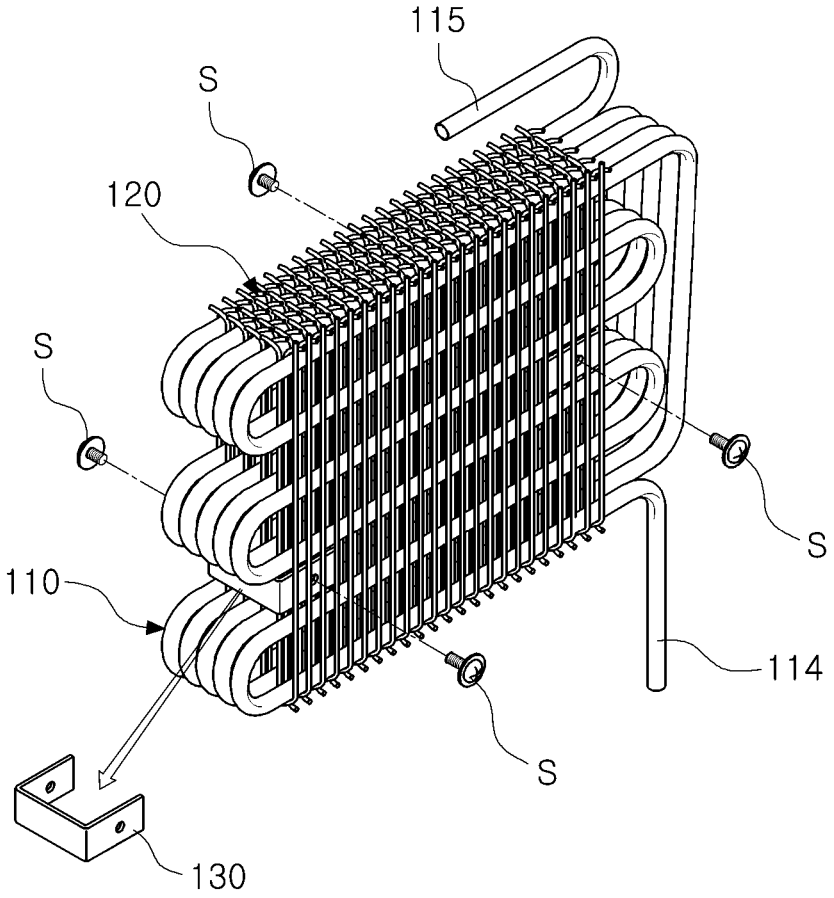

Then, as illustrated in FIG. 8, the cooling wire 120 may be fixed through the fixing member 130 to fix the pipe 110. In this case, the fixing member 130 may be provided with a screw S. A single screw S may be installed in each of an upper portion and a lower portion of the fixing member 130. In addition, the fixing member 130 may include a plurality of fixing members 130 installed.

Then, a copper tube through which a refrigerant flows may be bonded to an inlet 114 and an outlet 115 of the pipe 110.

As described above, after a wire to be formed as the cooling wire 120 is installed in a state in which a portion of the bending portion 10 is moved to an upper side, the bending portion 10 moved to the upper side may be bent while returning to an original position thereof. Thus, the cooling wires 120 may be alternately disposed.

Accordingly, since a volume of the condenser 100 may be reduced, the condenser 100 may be used for domestic/business water purifiers.

While example embodiments have been shown and described above, it will be apparent to those skilled in the art that modifications and variations could be made without departing from the scope of the present disclosure as defined by the appended claims.

The invention claimed is:

1. A condenser for a water purifier, the condenser comprising:

a pipe including a plurality of bending portions disposed to vertically overlap each other;

a cooling wire installed on each of upper surfaces and lower surfaces of the plurality of bending portions; and a fixing member configured to fix the cooling wire, wherein the cooling wires installed on surfaces, disposed to oppose each other, of the plurality of bending portions are alternately disposed.

2. The condenser of claim 1, wherein the cooling wires installed on one surface of the bending portion are disposed to have a plurality of rows.

3. The condenser of claim 1, wherein the cooling wire has a diameter of 1.0 mm to 1.2 mm.

4. The condenser of claim 1, wherein the pipe has a diameter of 4.5 mm to 5 mm.

5. The condenser of claim 1, wherein the pipe further includes a connection portion connecting a plurality of bending portions.

6. The condenser of claim 5, wherein the pipe includes a first bending portion provided with an inlet, a first connection portion extending from an end of the first bending portion; a second bending portion connected to an end of the first connection portion; a second connection portion extending from an end of the second bending portion; a third bending portion connected to an end of the second connection portion; a third connection portion extending from an end of the third bending portion; a fourth bending portion connected to an end of the third connecting portion; a fourth connection portion extending from an end of the fourth bending portion; and a fifth bending portion connected to the end of the fourth connecting portion and provided with an outlet.

7. The condenser of claim 6, wherein one end of the cooling wire installed in the first bending portion, both ends of the cooling wires installed in the second to fifth bending portions, and the other end of the cooling wire installed in the fifth bending portion are bent.

8. A water purifier comprising:

a main body case having an internal space and provided with a suction port through which external air is introduced;

a condenser of claim 1, installed in the internal space of the main body case and disposed in a discharge port of the main body case;

a blowing fan disposed on a front end of the condenser to allow air in the internal space of the main body case to pass through the condenser and to then be discharged outwardly of the main body case; and a cold water production unit disposed in the internal space of the main body case to produce cold water using a cooling system including the condenser, wherein the air in the internal space of the main body case is discharged outwardly of the main body case after passing through the condenser.

9. A method for manufacturing a condenser for a water purifier, the method comprising:

bending a pipe to form a plurality of bending portions;

comparing an even or odd bending portion, among the plurality of bending portions, with an adjacent bending portion to move the even or odd bending portion upwardly or downwardly by a predetermined interval;

installing a wire on an upper surface and a lower surface of the bending portion to form a plurality of rows;

removing a wire, disposed between the bending portions adjacent to the plurality of bending portions, to form a cooling wire; and bending the pipe to overlap the plurality of bending portions with each other, wherein in the bending the pipe to overlap the plurality of bending portions with each other, an even or odd bending portion is moved downwardly or upwardly, opposing an initial moving direction, to overlap an adjacent bending portion.

10. The method of claim 9, wherein the predetermined interval corresponds to half of an interval between the rows of the wire.

11. The method of claim 9, wherein cooling wires disposed on opposing surfaces of the bending portion are alternately disposed when the pipe is bent to overlap the plurality of bending portions with each other.

12. The method of claim 9, wherein the cooling wire has a diameter of 1.0 mm to 1.2 mm.

13. The method of claim 9, wherein the pipe has a diameter of 4.5 mm to 5 mm.

14. The method of claim 9, after bending the pipe to overlap the plurality of bending portions with each other, further comprising:

compressing the pipe while correcting a shape of the pipe; and installing a fixing member on the cooling wire.

15. The method of claim 14, wherein the installing the fixing member on the cooling wire comprises installing screws in an upper portion and a lower portion of the fixing member disposed to surround the cooling wire.

16. The method of claim 14, after installing the fixing member on the cooling wire, further comprising:

bonding a copper tube, through which a refrigerant flows, to the pipe.

* * * * *